United States Patent [19]

Funk et al.

[11] 4,400,784

[45] Aug. 23, 1983

[54] CONTROL OF A CRACKING FURNACE

[75] Inventors: Gary L. Funk, Bartlesville, Okla.; Warren H. Huang, Taipei, Taiwan; William S. Stewart, Bartlesville, Okla.

[73] Assignee: Phillips Petroleum Company, Bartlesville, Okla.

[21] Appl. No.: 238,392

[22] Filed: Feb. 25, 1981

[51] Int. Cl.[3] ..... G06F 15/46

[52] U.S. Cl. ..... 364/500; 208/DIG. 1; 422/62; 422/110

[58] Field of Search ..... 364/500, 501, 502, 164, 364/165, 557; 208/DIG. 1, 106, 132, 48 Q, 48 R; 23/230 A; 422/62, 108, 109–111; 585/501, 648, 650

[56] References Cited

U.S. PATENT DOCUMENTS

| | | | |
|---|---|---|---|
| 3,112,880 | 12/1963 | Pollock | 208/132 |
| 3,271,472 | 9/1966 | Ogle et al. | 208/DIG. 1 |
| 3,824,388 | 7/1974 | Cugini | 364/501 |
| 4,187,542 | 2/1980 | Ball et al. | 364/502 |
| 4,231,753 | 11/1980 | Stewart | 23/230 A |
| 4,236,218 | 11/1980 | Killebrew, Jr. et al. | 364/500 |
| 4,318,178 | 3/1982 | Stewart et al. | 23/230 A |

OTHER PUBLICATIONS

"Computer Control of Severity in Ethylene Cracking Furnaces" by Baxley, Jr., Published in Instrumentation Technology, pp. 39–42, Nov., 1971.

"You Can Capitalize on Light Feed Composition Changes" by Stewart et al., Published in the Oil and Gas Journal, pp. 98–111, Apr. 2, 1979.

*Primary Examiner*—Gary Chin

[57] ABSTRACT

Measurements of process variables associated with a cracking furnace are utilized to calculate the actual maximum tube skin temperature for the cracking furnace. The thus calculated actual maximum tube skin temperature is then utilized to derive a control signal which may be utilized to manipulate the rate at which heat is supplied to the cracking furnace. The accurate prediction of the actual tube skin temperature based on actual process measurements enables the conversion rate for the cracking furnace to be substantially maximized while preventing damage to the cracking tubes.

8 Claims, 2 Drawing Figures

CONTROL OF A CRACKING FURNACE

Figure 1:
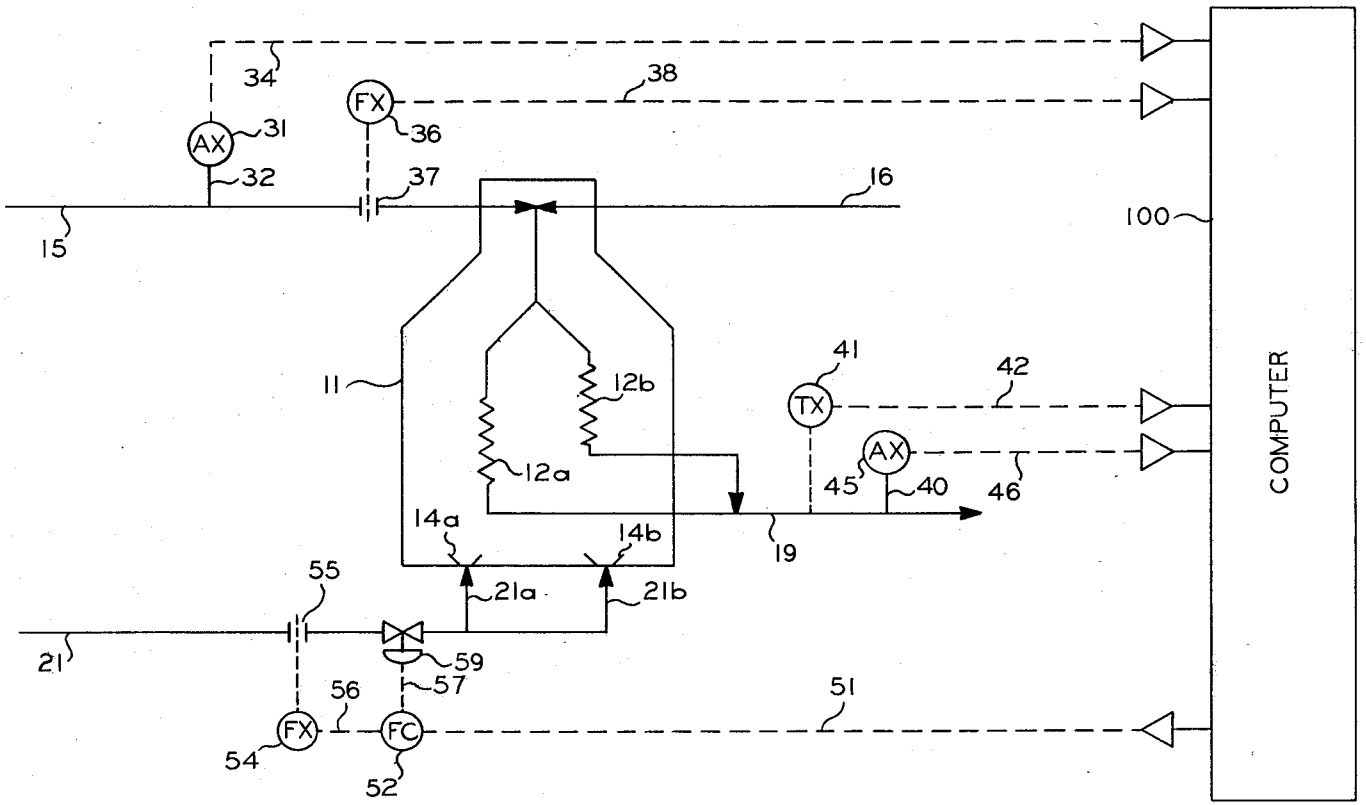

This invention relates to control of a cracking furnace. In a particular aspect this invention relates to method and apparatus for controlling the heat supplied to a cracking furnace so as to maintain a desired maximum tube skin temperature in the cracking furnace.

The cracking furnace forms the heart of many chemical manufacturing processes. Often the performance of the cracking furnace will carry the burden of the major profit potential for the entire manufacturing process. Close control of the cracking furnace is required to maintain a desired conversion rate in the cracking furnace and to prevent damage to the cracking furnace.

In a manufacturing process such as the manufacture of ethylene, a feedstock such as ethane and/or propane and/or naphtha is fed together with a diluent fluid such as steam into the cracking furnace. Within the furnace, the feed gas is converted to a gaseous effluent mixture which primarily contains hydrogen, methane, ethylene, propylene, butadiene and uncracked feed components. The exact composition of the gaseous effluent mixture will depend on the feed stock used. Obviously, if the feed is essentially ethane, very small amounts, if any, of propylene and butadiene will be present. At the furnace exit this mixture is cooled, which allows removal of most of the heavier gases, and compressed.

The compressed mixture is routed through various distillation columns where the individual components such as ethylene and propylene are purified and separated. The separated products, of which ethylene is the major product, then leave the ethylene plant to be used in numerous other processes for the manufacture of a wide variety of secondary products.

The primary function of the cracking furnace is to convert the feedstock to ethylene and/or propylene. The temperature of the cracking furnace is the major factor in determining the percentage of ethane and/or propane and/or naphtha that will be converted to ethylene and to propylene in the cracking furnace. Higher cracking furnace temperatures generally result in higher conversion. However, metallurgical limitations for the cracking tube skin temperature place an absolute limit on the temperature which may be achieved in the cracking furnace. Thus, operation close to the temperature limit imposed by metallurgical considerations is desirable to maximize conversion while still preventing damage to the cracking furnace.

The skin temperature for the cracking tubes will not be constant throughout the cracking furnace. Carbon deposition varies throughout the tubes and larger carbon deposits in particular areas result in higher tube skin temperatures in those areas (hot spots). Thus, the tube skin temperature of interest is the maximum tube skin temperature in the cracking furnace. It is possible to measure the maximum tube skin temperature in a cracking furnace using infrared pyrometric instruments. However, accurate infrared measurements are difficult to obtain and such measurements are made infrequently (every 4–8 hours is typical). Because of inaccuracies and infrequent measurements, such measurements are utilized only to periodically insure an operator that he is not exceeding a tube skin temperature constraint. Actual control of the tube skin temperature is based on measurements of the temperature of the effluent flowing from the cracking furnace.

The problem with controlling tube skin temperatures based on the outlet temperature is that the outlet temperature is representative of the average tube skin temperature and not the maximum tube skin temperature. Variations in carbon deposition may result in hot spots which vary by as much as 100° F. from the average tube skin temperature. Thus, in typical operations of a cracking furnace, the maximum tube skin temperature is held substantially (100° F.) below the metallurgical limit for the cracking tubes.

Maintenance of such a large margin between the metallurgical limit for the tube skin temperature and the actual maximum tube skin temperature results in considerable loss of conversion. Taking the general margin of 100° F. as an example, calculations have indicated that operation of an average of only 10° F. closer to the tube skin temperature limit will allow the plant production of ethylene plus propylene to be increased 31 million pounds per year for a 720 million pound per year plant using an ethane and propane mixture as a feed. A margin of 90° F. instead of 100° F. is thus worth 31 million pounds per year extra production.

It is thus an object of this invention to provide method and apparatus for controlling the heat supplied to a cracking furnace so as to operate the cracking furnace at a desired maximum tube skin temperature which is closer to the tube skin temperature limit than operation based on measurements of the actual effluent temperature would allow. It is another object of this invention to provide method and apparatus for utilizing measurements of process variables to calculate the actual maximum tube skin temperature so that control of the maximum tube skin temperature does not have to rely on a measurement which is not actually representative of the maximum tube skin temperature.

In accordance with the present invention, method and apparatus is provided whereby measurements of process variables associated with a cracking furnace are utilized to calculate the actual maximum tube skin temperature. The thus calculated actual maximum tube skin temperature may then be compared to a desired maximum tube skin temperature with the results of the comparison being utilized to manipulate the rate at which heat is supplied to the cracking furnace. The accurate calculation of the actual maximum tube skin temperature based on actual process measurements enables the safety margin between the actual maximum tube skin temperature and the metallurgical limit for the tube skin temperature to be decreased which results in substantially improved conversion in the cracking furnace.

Figure 2:
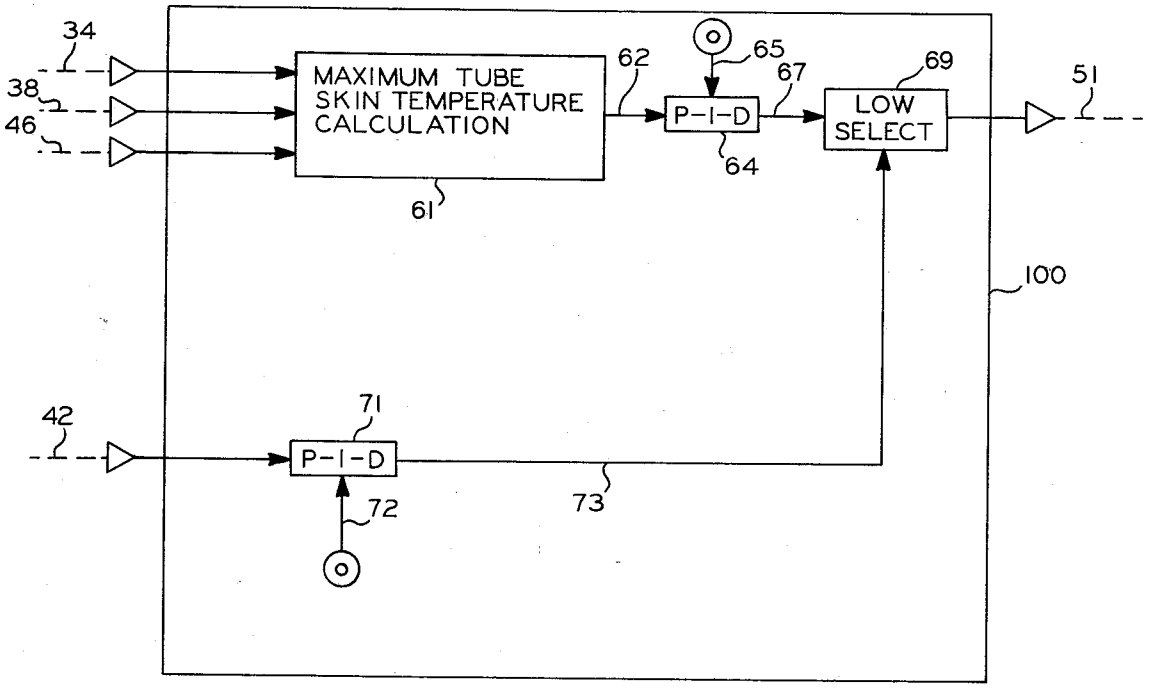

Other objects and advantages of the invention will be apparent from the foregoing brief description of the invention and the appended claims as well as from the detailed description of the drawings in which:

FIG. 1 is a schematic diagram of a cracking furnace with an associated control system; and FIG. 2 is a logic diagram for the computer logic utilized to generate the control signals utilized in the control of the cracking furnace illustrated in FIG. 1.

For the sake of simplicity the invention is illustrated and described in terms of a single cracking furnace having only two burners and heating sections. However, the invention is also applicable to multiple furnaces and is applicable to furnaces having only one burner and heating section or a plurality of burners and heating sections.

The invention is also illustrated and described in terms of a process for the manufacture of ethylene and propylene. However, the applicability of the invention described herein extends to other processes wherein a cracking furnace is utilized to crack a feed into some desired components. A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 7000 Process Computer System from Applied Automation, Inc., Bartlesville, Oklahoma.

Signal lines are also utilized to represent the results of calculations carried out in a digital computer and the term "signal" is utilized to refer to such results. Thus, the term signal is used not only to refer to electrical currents or pneumatic pressures but is also used to refer to binary representations of a calculated or measured value.

Both the analog and digital controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention. The operation of proportional-integral-derivative controllers is well known in the art. The output control signal of a proportional-integral-derivative controller may be represented as $$S=K_1E+K_2\int Edt+K_3dE/dT$$

where

S=output control signals;

E=difference between two input signals; and $K_1$, $K_2$ and $K_3$=constants.

The scaling of an output signal by a controller is well known in control system art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to FIG. 1, a conventional cracking furnace 11 is illustrated having two cracking tubes 12*a* and 12*b*. Heat is supplied to the two cracking tubes 12*a* and 12*b* by means of burners 14*a* and 14*b* respectively. As has been previously stated, the cracking furnace 11 is illustrated as having only two burners and two cracking tubes for the sake of convenience. Ordinarily a cracking furnace used in a process such as the manufacture of ethylene will have a large number of cracking tubes and burners. Also, in a process such as the manufacture of ethylene, a plurality of cracking furnaces will commonly be utilized.

A feedstock such as a mixture of ethane and propane is provided as a feed to the cracking furnace 11 through conduit means 15. Steam is provided to the cracking furnace 11 through conduit means 16. The feed gas flowing through conduit means 15 and the steam flowing through conduit means 16 are combined within the cracking furnace 11 and flow through the cracking tubes 12*a* and 12*b*. After passing through the cracking tubes 12*a* and 12*b* in which a part of the feed is converted to ethylene, propylene and other gases, the gaseous mixture is combined and flows to various distillation columns through conduit means 19.

Fuel is supplied to the cracking furnace 11 through conduit means 21. Specifically, fuel is supplied to burner 14*a* through conduit means 21*a* which is operably connected to conduit means 21. Fuel is supplied to burner 14*b* through conduit means 21*b* which is also operably connected to conduit means 21.

The cracking furnace, described to this point, is a conventional cracking furnace system. It is the manner in which the cracking furnace, illustrated in FIG. 1, is controlled so as to maintain a desired tube skin temperature which provides the novel features of the present invention.

A sample of the feed flowing through conduit means 15 is provided to the analyzer transducer 31 through conduit means 32. The analyzer transducer 31 is preferably a chromatograhic analyzer. In the case of a feedstock which is a mixture of ethane and propane, the analyzer transducer 31 provides an output signal 34 which is representative of the concentration of the ethane and propane in the feed flowing through conduit means 15. Signal 34 is provided from the analyzer transducer 31 as an input to computer means 100.

Flow transducer 36 in combination with flow sensor 37, which is operably located in conduit means 15, provides an output signal 38 which is representative of the actual flow rate of the feed flowing through conduit means 15. Signal 38 is provided from the flow transducer 36 as an input to computer means 100.

Temperature transducer 41 in combination with a temperature measuring device such as a thermocouple, which is operably located in conduit means 19, provides an output signal 42 which is representative of the actual temperature of the effluent flowing through conduit means 19. Signal 42 is provided from the temperature transducer 41 as an input to computer means 100.

A sample of the effluent flowing through conduit means 19 is provided to the analyzer transducer 45 through conduit means 46. The analyzer transducer 45 is preferably a chromatographic analyzer. The analyzer transducer 45 provides an output signal 46 which is representative of the concentration of one major component present in the gaseous mixture that was also present in the feed. As an example, signal 46 is representative of the concentration of propane in the effluent flowing through conduit means 19. Signal 46 is provided from the analyzer transducer 45 as an input to computer means 100.

In response to the described input signals, computer means 100 calculates the flow rate of the fuel flowing through conduit means 21 required to maintain a desired maximum tube skin temperature in the cracking furnace 11. Signal 51, which is representative of this desired flow rate, is provided from computer means 100 as the set point input to the flow controller 52. The flow transducer 54 in combination with the flow sensor 55 which is operably located in conduit means 21 provides an output signal 56 which is representative of the actual flow rate of the fuel flowing through conduit means 21. Signal 56 is provided as the process variable signal to the flow controller 52. The flow controller 52 provides an output signal 57 which is responsive to the difference between signals 51 and 56. Signal 57 is provided from the flow controller 52 to the control valve 59 which is operably located in conduit means 21. The control valve 59 is manipulated in response to signal 57 to thereby maintain the actual flow rate of the fuel flowing through conduit means 21 substantially equal to the desired flow rate as represented by signal 51.

Only the specific control elements required to illustrate the present invention have been described. A large amount of additional control equipment is generally utilized to control a cracking furnace. However, since this additional control equipment is well known and is not required for an understanding of the present invention, such additional control equipment has not been described for the sake of simplicity and clarity.

If the BTU content of the fuel flowing through conduit means 21 is substantially constant, then the specific described control of the fuel flow illustrated will operate quite satisfactorily. However, if the BTU content is variable, it may be desirable to analyze the fuel flowing through conduit means 21 to determine the specific BTU content and use the specific BTU content to determine the number of BTU's actually being provided to the cracking furnace per unit time. Signal 51 would then be scaled to be representative of the desired number of BTU's which must be provided to the cracking furnace per unit time. A comparison of the actual and desired would again be utilized to derive a control signal which would be used to manipulate the control valve 59.

The following discussion regarding the calculation of the maximum tube skin temperature in the cracking furnace is provided to simplify the computer logic illustrated in FIG. 2 and illustrate the basis for the maximum tube skin temperature calculation. The actual maximum tube skin temperature in the cracking furnace is given by:

$$T_{max} = A_0 + (B_0)(F_x)(CONV) + (B_1)(C_3) + (B_2)(C_2) \quad (1)$$

where $T_{max}$ = maximum tube skin temperature in the cracking furnace;

$F_x$ = flow rate of the feed flowing through conduit means 15;

CONV = percent conversion of a major component in the feed flowing through conduit means 15 (propane in the example being utilized);

$C_3$ = concentration of propane in the feed flowing through conduit means 15;

$C_2$ = concentration of ethane in the feed flowing through conduit means 15; and $A_0$, $B_0$, $B_1$ and $B_2$ are constants.

The value to be used for $F_x$ is provided by signal 38. The analysis of the effluent flowing through conduit means 15 provides the values for $C_2$ and $C_3$. The percent conversion may be determined by utilizing:

$$CONV = (1 - C_3/C_{3OUT})(100) \quad (2)$$

where $C_{3OUT}$ is representative of a concentration of propane in the effluent flowing through conduit means 19 and is provided by signal 46. Analysis for ethane may also be used to determine the percent conversion if desired.

The values of the constants in Equation (1) are determined by actually measuring the maximum tube skin temperature in a cracking furnace at different flow rates of the feed, percentage conversions and concentrations of ethane and propane in the feed. A regression type fit or polynomial fit is then utilized to derive the values of the constants in Equation (1) which will enable Equation (1) to give the actual maximum tube skin temperature measured in the process test. Once the constants have been established, then the process model represented by Equation (1) can be utilized to predict the actual maximum tube skin temperature based on the analysis of the feed stream and effluent stream and the flow rate of the feed stream.

An example of a group of constants which were determined for an actual cracking furnace are as follows:

$A_0 = +1636.873419$ $B_0 = +0.000203$ $B_1 = -2.69265$ $B_2 = +0.0000017$

Since all of the terms of Equation (1) will be known, Equation (1) may be solved by the computer to calculate the actual maximum tube skin temperature for the cracking furnace 11 based on the analysis of the feed stream, the analysis of the effluent stream and the flow rate of the feed stream. This calculation is utilized in the computer logic as will be described hereinafter.

The logic flow diagram utilized to calculate the control signal 51 in response to the previously described input signals to computer means 100 is illustrated in FIG. 2. Referring now to FIG. 2, computer means 100 is shown as a solid line surrounding the flow logic.

Signal 34, which is representative of the concentration of ethane and the concentration of propane in the feed flowing through conduit means 15, is provided as an input to the maximum tube skin temperature calculation block 61. In like manner, signal 38 which is representative of the flow rate of the feed flowing through conduit means 15 and signal 46 which is representative of the concentration of propane in the effluent flowing through conduit means 19 are provided as inputs to the maximum tube skin temperature calculation block 61. In response to the described input signals, the maximum tube skin temperature is calculated based on Equations (1) and (2) to derive signal 62 which is representative of the calculated actual maximum tube skin temperature. Signal 62 is provided from the maximum tube skin temperature calculation block 61 as the process variable input to the proportional-integral-derivative (P-I-D) controller block 64. The P-I-D controller block 64 is also provided with a set point signal 65 which is representative of the desired maximum tube skin temperature in the cracking furnace. Signal 65 is preferably within approximately 50° F. of the metallurgical limit for the maximum tube skin temperature.

In response to signals 62 and 65, the P-I-D block 64 establishes an output signal 67 which is responsive to the difference between signals 62 and 65. Signal 67 is scaled so as to be representative of the flow rate of fuel to the cracking furnace required to maintain the calculated actual maximum tube skin temperature substantially equal to the desired maximum tube skin temperature represented by signal 65. Signal 67 is provided from the P-I-D block 64 as a first input to the low select block 69.

Signal 42, which is representative of the actual temperature of the effluent flowing through conduit means 19, is provided as the process variable input to the P-I-D controller block 71. The P-I-D controller block 71 is also provided with a set point signal 72 which is representative of the maximum allowable temperature for the effluent flowing through conduit means 19. The P-I-D controller block 71 provides an output signal 73 which is responsive to the difference between signals 42 and 72. Signal 73 is scaled so as to be representative of the flow rate of the fuel flowing through conduit means 21 required to maintain the actual effluent temperature substantially equal to the maximum allowable effluent temperature. In effect, signal 73 is representative of a maximum allowable flow rate and is utilized as a safety factor in the control system. Signal 73 is provided from the P-I-D controller block 71 as a second input to the low select block 69.

The low select block 69 selects the lower of signals 67 and 73 to be provided as signal 51. Signal 51 is provided from the low select block 69 as an output signal from computer means 100 and is utilized as has been previously described.

In general, signal 67 will be selected as the controlling signal. Only in such circumstances that result in signal 67 requiring a flow rate which would exceed the maximum allowable flow rate represented by signal 73 will signal 73 be utilized as the controlling signal.

The invention has been described in terms of a preferred embodiment as illustrated in FIGS. 1 and 2. Specific components which can be used in the practice of the invention as illustrated in FIG. 1 such as flow sensors 37 and 55; flow transducers 36 and 54; temperature transducer 41; flow controller 52 and control valve 59 are each well known, commercially available control components such as are illustrated and described at length in Perry's *Chemical Engineer's Handbook,* 4th Edition, Chapter 22, McGraw-Hill. A suitable chromatographic analyzer is the Process Chromatograph System, Model 102, manufactured by Applied Automation, Bartlesville, Oklahoma.

While the invention has been described in terms of the presently preferred embodiment, reasonable variations and modifications are possible by those skilled in the art as has been discussed. Such variations and modifications are within the scope of the described invention and the appended claims.

That which is claimed is:

1. Apparatus comprising:

a cracking furnace means;

means for supplying a feed stream to said cracking furnace means;

means for supplying a diluent fluid to said cracking furnace means, said diluent fluid being combined with said feed stream;

means for supplying a fuel to said cracking furnace means, the combustion of said fuel supplying heat to said cracking furnace means;

means for removing a gaseous mixture, containing the cracked components of said feed stream and containing said diluent fluid, from said cracking furnace means;

means for establishing a first signal representative of a calculated actual maximum tube skin temperature based on the measurements of process variables associated with said cracking furnace means;

means for establishing a second signal representative of a desired maximum tube skin temperature for said cracking furnace means;

means for comparing said first signal and said second signal and for establishing a third signal responsive to the difference between said first signal and said second signal; and means for manipulating the heat supplied to said cracking furnace means in response to said third signal to thereby maintain the calculated actual maximum tube skin temperature substantially equal to the desired maximum tube skin temperature.

2. Apparatus in accordance with claim 1 wherein said means for establishing said first signal comprises:

means for establishing a fourth signal representative of the flow rate of said feed stream;

means for establishing a fifth signal representative of the concentration of ethane in said feed stream;

means for establishing a sixth signal representative of the concentration of propane in said feed stream;

means for establishing a seventh signal representative of the concentration of propane in said effluent stream; and means for calculating the value of said first signal in response to said fourth, fifth, sixth and seventh signals.

3. Apparatus in accordance with claim 1 wherein said third signal is scaled so as to be representative of the flow rate of said fuel required to maintain the calculated actual maximum tube skin temperature substantially equal to the desired maximum tube skin temperature and wherein said means for manipulating the heat supplied to said cracking furnace means in response to said third signal comprises:

means for establishing a fourth signal representative of the actual flow rate of said fuel;

means for comparing said third signal and said fourth signal and for establishing a fifth signal responsive to the difference between said third signal and said fourth signal;

a control valve means located in said means for supplying said fuel to said cracking furnace means; and means for manipulating said control valve means in response to said fifth signal.

4. Apparatus in accordance with claim 1 wherein said third signal is scaled so as to be representative of the flow rate of said fuel required to maintain the calculated actual maximum tube skin temperature substantially equal to the desired maximum tube skin temperature and wherein said means for manipulating the heat supplied to said cracking furnace means in response to said third signal comprises:

means for establishing a fourth signal representative of the temperature of said gaseous mixture;

means for establishing a fifth signal representative of the maximum allowable temperature of said gaseous mixture;

means for comparing said fourth signal and said fifth signal and for establishing a sixth signal responsive to the difference between said fourth signal and said fifth signal, wherein said sixth signal is scaled so as to be representative of the flow rate of said fuel required to maintain the actual temperature of said gaseous mixture substantially equal to the maximum allowable temperature of said gaseous mixture;

low select means;

means for providing said third signal and said sixth signal as inputs to said low select means, said low select means establishing a seventh signal representative of the lower of said third and sixth signals;

means for establishing an eighth signal representative of the actual flow rate of said fuel;

means for comparing said seventh signal and said eighth signal and for establishing a ninth signal responsive to the difference between said seventh signal and said eighth signal;

a control valve means located in said means for supplying said fuel to said cracking furnace means; and means for manipulating said control valve means in response to said ninth signal.

5. A method for maintaining a desired maximum tube skin temperature for a cracking furnace in which a mixture of a feed stream and a diluent fluid are cracked to produce a gaseous mixture which contains cracked and uncracked components of said feed stream and contains said diluent fluid, said method comprising the steps of:

establishing a first signal representative of a calculated actual maximum tube skin temperature based on the measurements of process variables associated with said cracking furnace means;

establishing a second signal representative of a desired maximum tube skin temperature for said cracking furnace means;

comparing said first signal and said second signal and establishing a third signal responsive to the difference between said first signal and said second signal; and manipulating the heat supplied to said cracking furnace means in response to said third signal to thereby maintain the calculated actual maximum tube skin temperature substantially equal to the desired maximum tube skin temperature.

6. A method in accordance with claim 5 wherein said step of establishing said first signal comprises:

establishing a fourth signal representative of the flow rate of said feed stream;

establishing a fifth signal representative of the concentration of ethane in said feed stream;

establishing a sixth signal representative of the concentration of propane in said feed stream;

establishing a seventh signal representative of the concentration of propane in said effluent stream; and calculating the value of said first signal in response to said fourth, fifth, sixth and seventh signals.

7. A method in accordance with claim 5 wherein a fuel is supplied to said cracking furnace with the combustion of said fuel supplying heat to said cracking furnace, wherein said third signal is scaled so as to be representative of the flow rate of said fuel required to maintain the calculated actual maximum tube skin temperature substantially equal to the desired maximum tube skin temperature and wherein said step of manipulating the heat supplied to said cracking furnace means in response to said third signal comprises:

establishing a fourth signal representative of the actual flow rate of said fuel;

comparing said third signal and said fourth signal and establishing a fifth signal responsive to the difference between said third signal and said fourth signal; and manipulating the flow of fuel to said cracking furnace in response to said third signal.

8. A method in accordance with claim 5 wherein a fuel is supplied to said cracking furnace with the combustion of said fuel supplying heat to said cracking furnace, wherein said third signal is scaled so as to be representative of the flow rate of said fuel required to maintain the calculated actual maximum tube skin temperature substantially equal to the desired maximum tube skin temperature and wherein said step of manipulating the heat supplied to said cracking furnace in response to said third signal comprises:

establishing a fourth signal representative of the temperature of said gaseous mixture;

establishing a fifth signal representative of the desired temperature of said gaseous mixture;

comparing said fourth signal and said fifth signal and establishing a sixth signal responsive to the difference between said fourth signal and said fifth signal, wherein said sixth signal is scaled so as to be representative of the flow rate of said fuel required to maintain the actual temperature of said gaseous mixture substantially equal to maximum allowable temperature of said gaseous mixture;

establishing a seventh signal representative of the lower of said third and sixth signals;

establishing an eighth signal representative of the actual flow rate of said fuel;

comparing said seventh signal and said eighth signal and establishing a ninth signal responsive to the difference between said seventh signal and said eighth signal; and manipulating the flow of said fuel in response to said ninth signal.

* * * * *